US009010291B2

(12) United States Patent
Haga et al.

(10) Patent No.: US 9,010,291 B2
(45) Date of Patent: Apr. 21, 2015

(54) LASH ADJUSTER

(71) Applicant: Otics Corporation, Nishio-shi, Aichi (JP)

(72) Inventors: Yoshiaki Haga, Nishio (JP); Hiroki Yamamoto, Hekinan (JP)

(73) Assignee: Otics Corporation, Nishio-Shi, Aichi (JP)

( * ) Notice: Subject to any disclaimer, the term of this patent is extended or adjusted under 35 U.S.C. 154(b) by 0 days.

(21) Appl. No.: 14/175,670

(22) Filed: Feb. 7, 2014

(65) Prior Publication Data

US 2014/0230768 A1 Aug. 21, 2014

(30) Foreign Application Priority Data

Feb. 15, 2013 (JP) ..... 2013-027980

(51) Int. Cl.
*F01L 1/14* (2006.01)
*F01L 1/24* (2006.01)

(52) U.S. Cl.
CPC ..... *F01L 1/24* (2013.01); *F01L 1/2405* (2013.01); *F01L 2103/01* (2013.01)

(58) Field of Classification Search
CPC ..... F01L 1/24; F01L 1/2405
USPC ..... 123/90.48, 90.52, 90.55, 90.56
See application file for complete search history.

(56) References Cited

U.S. PATENT DOCUMENTS 5,509,385 A 4/1996 LaVieri
5,706,773 A 1/1998 Dura et al.
5,979,377 A 11/1999 Barth et al.
8,555,842 B2 * 10/2013 Janowiak ..... 123/90.52
2005/0178351 A1 8/2005 Mayer et al.
2014/0224201 A1 8/2014 Oka et al.

(Continued)

FOREIGN PATENT DOCUMENTS

DE 2343269 3/1975
DE 19614668 10/1997

(Continued)

OTHER PUBLICATIONS

European Search Report corresponding to co-pending EP application No. 14000199.1 dated Apr. 22, 2014.

(Continued)

*Primary Examiner* — Ching Chang
(74) *Attorney, Agent, or Firm* — Smith, Gambrell & Russell, LLP

(57) ABSTRACT

A lash adjuster includes a body formed into a bottomed cylindrical shape, a plunger movably inserted into the body and having a peripheral wall having an oil passage hole, and a partitioning member inserted into the plunger. The plunger defines a high-pressure chamber between the body and a plunger underside and includes a first threaded portion formed in an inner periphery of the peripheral wall. The partitioning member has an oil passage end located above the oil passage hole and an oil passage is defined between an outer surface of the partitioning member and the plunger peripheral wall. A low-pressure chamber is defined inside the partitioning member to reserve hydraulic fluid flowing through the oil passage hole. The hydraulic fluid is then supplied into the high-pressure chamber. The partitioning member has an outer periphery formed with a second threaded portion threadingly coupled with the first threaded portion.

5 Claims, 4 Drawing Sheets

(56) References Cited

U.S. PATENT DOCUMENTS

| | | | |
|---|---|---|---|
| 2014/0224202 | A1 | 8/2014 | Suzuki et al. |
| 2014/0230766 | A1 | 8/2014 | Fujii et al. |
| 2014/0230767 | A1 | 8/2014 | Yamamoto et al. |

FOREIGN PATENT DOCUMENTS

| | | |
|---|---|---|
| DE | 102005025765 | 12/2006 |
| DE | 10 2006 004751 | 8/2007 |
| DE | 10 2006 007375 | 8/2007 |
| DE | 10 2006 007376 | 8/2007 |
| DE | 10 2006 017442 | 10/2007 |
| EP | 1564383 | 8/2005 |
| JP | 57181908 | 11/1982 |
| JP | 61118509 | 6/1986 |
| JP | H06-37504 | 5/1994 |
| JP | 05-288019 | 11/2003 |
| JP | 2004-197665 | 7/2004 |
| JP | 2008-064020 | 3/2008 |
| WO | 9215776 | 9/1992 |
| WO | 2007/118820 | 10/2007 |

OTHER PUBLICATIONS

European Search Report corresponding to co-pending EP application No. 14000213.0 dated Apr. 22, 2014, listed in IDS for U.S. Appl. No. 14/175,560.

European Search Report corresponding to co-pending EP application No. 14000198.3 dated Apr. 14, 2014, listed in IDS for U.S. Appl. No. 14/175,610.

May 2014 generated European Search Report for EP Application No. 14000223, listed in IDS for U.S. Appl. No. 14/175,641.

May 15, 2015 generated European Search Report for EP Application No. 14000227, listed in IDS for U.S. Appl. No. 14/175,653.

* cited by examiner

LASH ADJUSTER

CROSS-REFERENCE TO RELATED APPLICATIONS

This application is based upon and claims the benefit of priority from the prior Japanese Patent Application No. 2013-27980 filed on Feb. 15, 2013, the entire contents of which are incorporated herein by reference.

BACKGROUND

1. Technical Field

The present invention relates to a lash adjuster.

2. Related Art

A conventional lash adjuster includes bottomed cylindrical body fixed to a cylinder head of an internal combustion engine and a plunger which is inserted into the body so that the plunger is movable up and down. The plunger has an upper end supporting a rocker arm. The plunger further has a peripheral wall formed with an oil passage hole or an inner communication hole and a bottom wall formed with a valve hole or a valve orifice. Hydraulic fluid, such as oil, supplied through an oil filler hole of the cylinder head is stored in a low-pressure chamber in the plunger through the oil passage hole and also supplied through the valve hole into the body thereby to fill the body. A high-pressure chamber is defined by dividing an interior of the body by the bottom wall of the plunger. The plunger is moved up and down according to oil pressure in the high-pressure chamber. The hydraulic fluid in the low-pressure chamber in the plunger is drawn through the valve hole into the high-pressure chamber when the plunger is moved upward. In this case, there is a possibility that air entrainment may occur in the high-pressure chamber when the hydraulic fluid level is low in the low-pressure chamber.

In view of the aforementioned problem, the conventional art provides a lash adjuster provided with a cylindrical partitioning member inserted into the plunger. A space inside the partitioning member serves as a low-pressure chamber. An oil passage or flow passage is formed between an inner periphery of the plunger and an outer periphery of the partitioning member. An oil passage end or a cutout is located above the oil passage hole. As a result, a large amount of hydraulic fluid is supplied from the oil passage hole via the oil passage and the oil passage end into the low-pressure chamber. Since the hydraulic fluid level depends upon the oil passage end located above the oil passage hole, air entrainment can be prevented in the high-pressure chamber.

The partitioning member is press-fitted into the plunger. In this case, if without execution of treatment such as shrinkage fitting, the dimensional control needs to be carried out under the condition where there is almost no fit tolerance between the inner diameter of the plunger and the outer diameter of the partitioning member or where a press fit allowance is zero or approximately zero. This requires a high machining accuracy and accordingly renders the machining difficult. Particularly in the above-described conventional art, the partitioning member has a stepped portion provided midway in the up-down direction. Accordingly, when the partitioning member is forcedly fitted into the plunger without appropriate control of the press fit allowance, there is concern that the partitioning member would be buckled from the stepped portion. Additionally, the shrinkage fitting, when carried out, would increase a man-hour in the manufacture of the lash adjusters with the result that workload is increased.

SUMMARY

Therefore, an object of the invention is to provide a lash adjuster which can improve working efficiency by reducing the machining accuracies of the plunger and the partitioning member.

The invention provides a lash adjuster including a body formed into a bottomed cylindrical shape and a plunger which is inserted into the body so as to be movable up and down and has a bottom wall having a valve hole formed therethrough and a peripheral wall standing from an outer periphery of the bottom wall and having an oil passage hole formed therethrough, so that the plunger is formed into a bottomed cylindrical shape. The plunger defines a high-pressure chamber between the bottom wall and the body and the plunger includes a plunger side threaded portion formed in an inner periphery of the peripheral wall thereof. A partitioning member has a tubular shape and is inserted into the plunger. In a state where the partitioning member is inserted into the plunger, the partitioning member has an oil passage end located above the oil passage hole and an oil passage is defined between an outer surface of the partitioning member and the peripheral wall of the plunger. A low-pressure chamber is defined inside the partitioning member to reserve hydraulic fluid flowing through the oil passage hole, the oil passage and the oil passage end into the low-pressure chamber. The hydraulic fluid reserved in the low-pressure chamber is supplied through the valve hole into the high-pressure chamber. The partitioning member has an outer periphery formed with a partitioning member side threaded portion threadingly coupled with the plunger side threaded portion.

The partitioning member is retained in the plunger by threadingly coupling the partitioning member side threaded portion with the plunger side threaded portion. In this case, the difference between an inner diameter of the plunger peripheral wall and an outer diameter of the partitioning member is absorbed by an engagement allowance of the partitioning member side threaded portion and the plunger side threaded portion. Accordingly, a strict dimensional control is not required for the inner diameter of the plunger peripheral wall and the outer diameter of the partitioning member. In this respect, the above-described construction clearly differs from the conventional construction in which the partitioning member is press-fitted into the plunger. That is, a machining or processing accuracy can be reduced and the workability can be improved.

DETAILED DESCRIPTION

Figure 1:
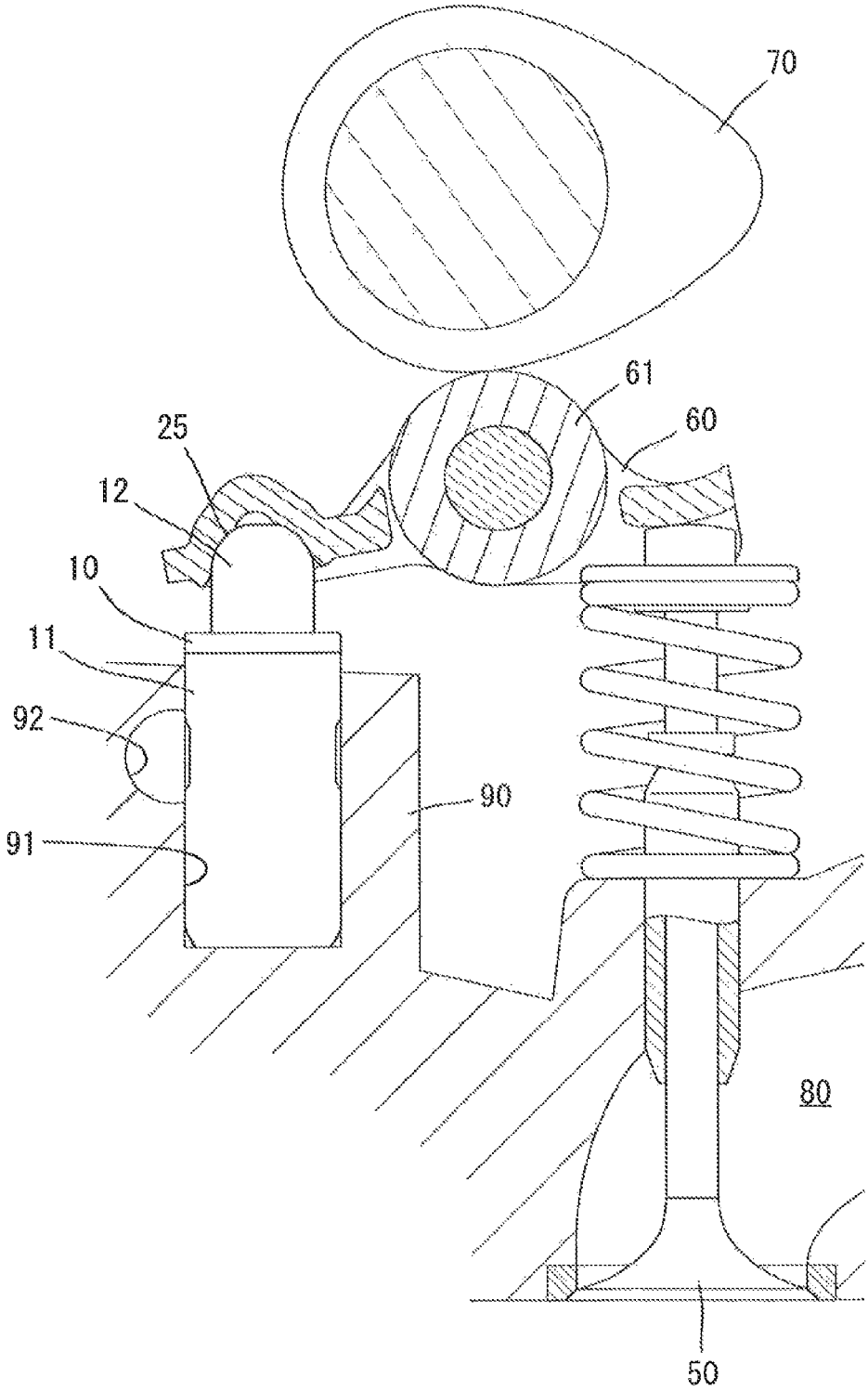
FIG. 1 is a schematic sectional view of an internal combustion engine in which a lash adjuster in accordance with one embodiment is incorporated.

One embodiment of the present invention will be described with reference to the accompanying drawings. Referring to FIG. 1, a lash adjuster 10 in accordance with the embodiment is shown. As shown, the lash. adjuster 10 is incorporated in a valve gear of an internal combustion engine. The valve gear includes a valve 50, a rocker arm 60 and a can 70 in addition to the lash adjuster 10.

The lash adjuster 10 is inserted into a mounting recess 91 of a cylinder head 90 from above. The valve 50 is provided to be capable of opening and closing an intake/exhaust port 80 of the cylinder head 90. The rocker arm 60 is disposed so as to extend between an upper end (a support portion 25 of a plunger 12 as will be described later) of the lash adjuster 10 and an upper end of the valve 50 in a right-left direction. The cam 70 is disposed above the rocker arm 60 so as to be slidable together with a roller 61 of the rocker arm 60. Upon rotation of the cam 70, the rocker arm 60 is swung in an up-down direction with the upper end of the lash adjuster 10 serving as a fulcrum. With swing of the rocker arm 60, the valve 50 is moved up and down thereby to open and close the intake/exhaust port 80.

Figure 2:
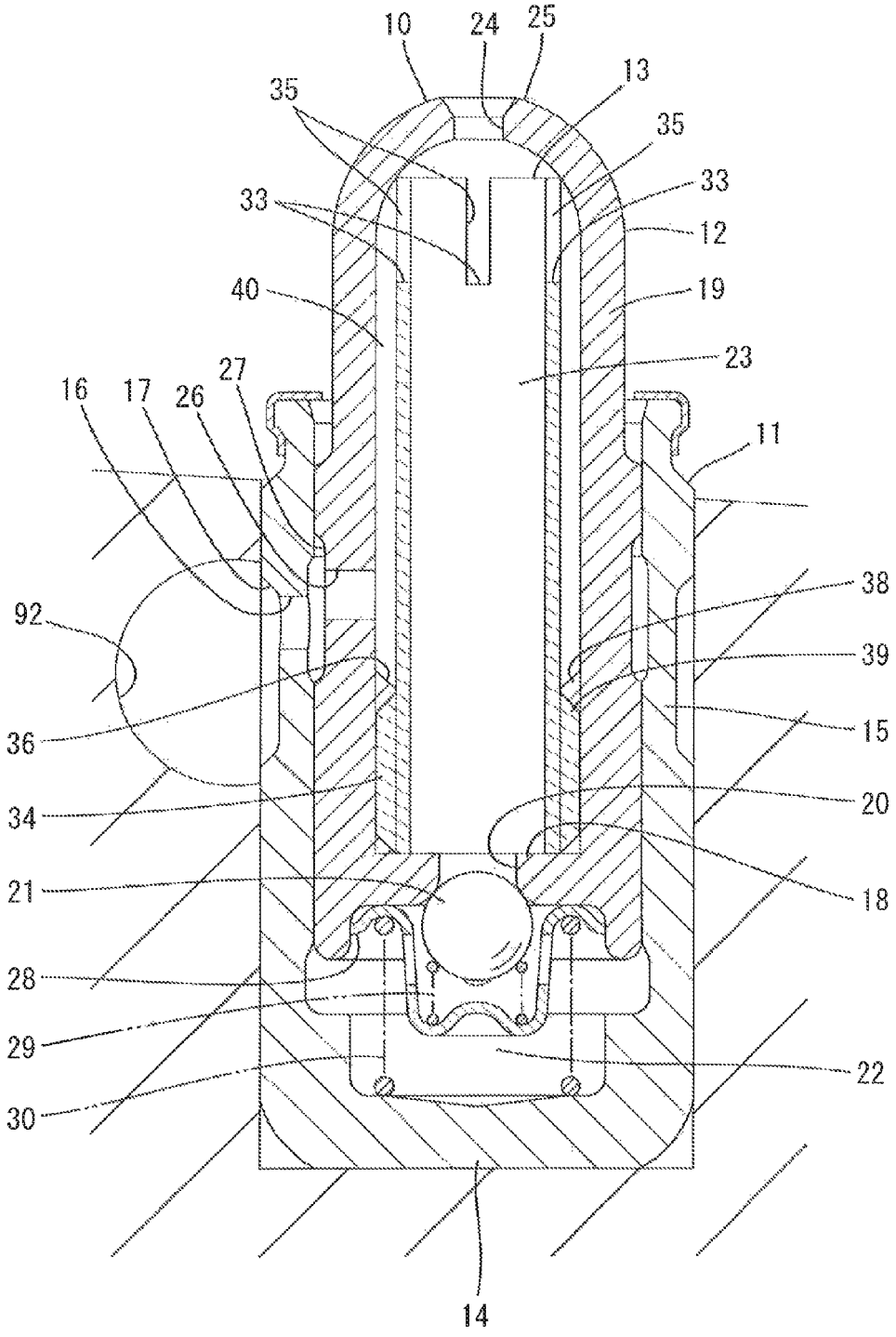
FIG. 2 is a sectional view of the lash adjuster.

The lash adjuster 10 will now be described more concretely. The lash adjuster 10 includes a body 11, a plunger 12 and a partitioning member 13 as shown in FIG. 2. The body 11 has a disc-shaped bottom wall 14 and a cylindrical peripheral wall 15 standing from an outer periphery of the bottom wall 14. The body 11 is formed into a bottomed cylindrical shape as a whole. The body 11 is fittable into the mounting recess 91 of the cylinder head 90. The peripheral wall 15 of the body 11 has an outer oil passage hole 16 formed therethrough. The outer oil passage hole 16 is disposed in communication with an oil filler hole 92 of the cylinder head 90. Furthermore, the body 11 has an outer periphery formed with an annular recess 17 which extends over the whole periphery thereof and in which the outer oil passage hole 16 is open. Accordingly, the outer oil passage hole 16 and the oil filler hole 92 are retained in communication via the annular recess 17 even when the body 11 is rotated in the mounting recess 91.

The plunger 12 has a disc-shaped bottom wall 18 and a cylindrical peripheral wall 19 standing from an outer periphery of the bottom wall 18 and is formed into a bottomed cylindrical shape as a whole. The bottom wall 18 includes a central part through which a valve hole 20 is formed. The valve hole 20 communicates between a high-pressure chamber 22 and a low-pressure chamber 23 via a valve element 21 as will be described later. The peripheral wall 19 has an upper end formed with a semispherical support portion 25 which is radially squeezed and has a centrally located through hole 24. The support portion 25 includes an outer semispherical surface on which a rocker arm 60 is adapted to slide during swinging.

The peripheral wall 19 is also formed with an oil passage hole 26. The peripheral wall 19 has an outer periphery formed with an annular recess 27 which extends over the whole periphery thereof and in which the oil passage hole 26 is open. The oil passage hole 26 communicates with the outer oil passage hole 16 of the body 11 via the annular recess 27, and the oil passage hole 26 and the outer oil passage hole 16 are retained in communication even when the plunger 12 is rotated in the body 11.

The high-pressure chamber 22 is defined between the bottom wall 18 of the plunger 12 and the body 11 when the plunger 12 is inserted into the body 11, as shown in FIG. 2. A spherical valve element 21 is provided in the high-pressure chamber 22. The valve element 21 is housed in a cage-like retainer 28 and biased by a first spring 29 in a direction such that the valve hole 23 is closed. The high-pressure chamber 22 is also provided with a second spring 30 located between the bottom wall 14 of the body 11 and an upper edge of the retainer 28. The plunger 12 is biased upward by the second spring 30.

The partitioning member 13 is inserted into the plunger 12. The partitioning member 13 is a metallic tubular body and is formed as a whole into the shape of a cylinder extending in the up-down direction. The partitioning member 13 is disposed so that a lower end thereof is in abutment with the bottom wall 18 of the plunger 12 and so that an upper end of the partitioning member 13 is in abutment with the support portion 25 located above the oil passage hole 26 when the partitioning member 13 is inserted into the plunger 12. More specifically, the partitioning member 13 has a uniform diameter in the up-down direction and a uniform circular section over a whole height thereof, so that the partitioning member 13 has no radial stepped portion midway in the up-down direction. The partitioning member 13 has an outer diameter that is set to be smaller than an inner diameter of the peripheral wall 19 of the plunger 12. As a result, an oil passage 40 has a width determined depending upon the difference between the outer diameter of the partitioning member 13 and the inner diameter of the peripheral wall 19 of the plunger 12.

Figure 3:
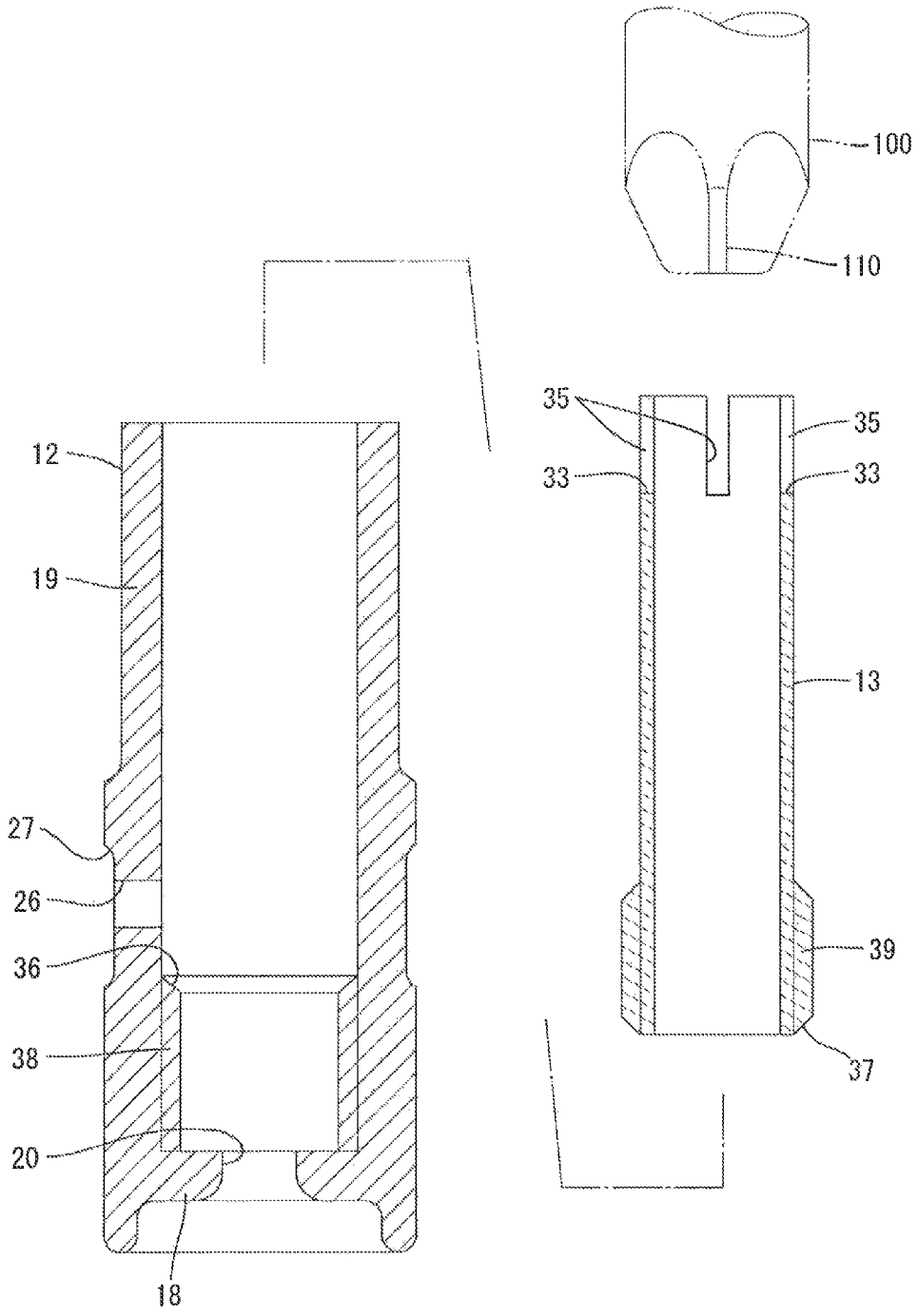
FIG. 3 is a sectional view of the plunger with which a partitioning member is to be coupled.

The partitioning member 13 has a partitioning member side threaded portion 39 formed integrally on the outer periphery of the lower end thereof as shown in FIG. 3. The threaded portion 39 has a male thread (not shown) which extends along the outer periphery thereof upward from the lower end of the partitioning member 13 (a predetermined range of a lower half of the partitioning member 13). The threaded portion 39 projects radially outward relative to the cylindrical body of the partitioning member 13.

The plunger 12 has a plunger side threaded portion 38 formed integrally on the inner periphery of the lower end of the peripheral wall 19 thereof. The threaded portion 38 has a female thread (not shown) which extends along the inner periphery thereof upward from the lower end of the peripheral wail 19 (a predetermined range of a lower half of the peripheral wall 19 located below the oil passage hole 26). The threaded portion 38 projects radially inward relative to the cylindrical body of the peripheral wall 19.

The threaded portion 38 has a vertical formation range that is substantially the same as a vertical formation range of the threaded portion 39. The threaded portion 39 is coupled with the threaded portion 38, whereby the partitioning member 13 held in a fixed state in the plunger 12. The threaded portion 38 has an upper end further having an inner peripheral surface formed with a tapered guide surface 36 tilted along a screw tightening direction. The threaded portion 39 has a lower end further having an outer peripheral surface formed with a tapered guide surface 37 tilted along the screw tightening direction. The threaded portion 39 is guided along both guide surfaces 36 and 37 to a threading engagement position with the threaded portion 38.

Figure 4:
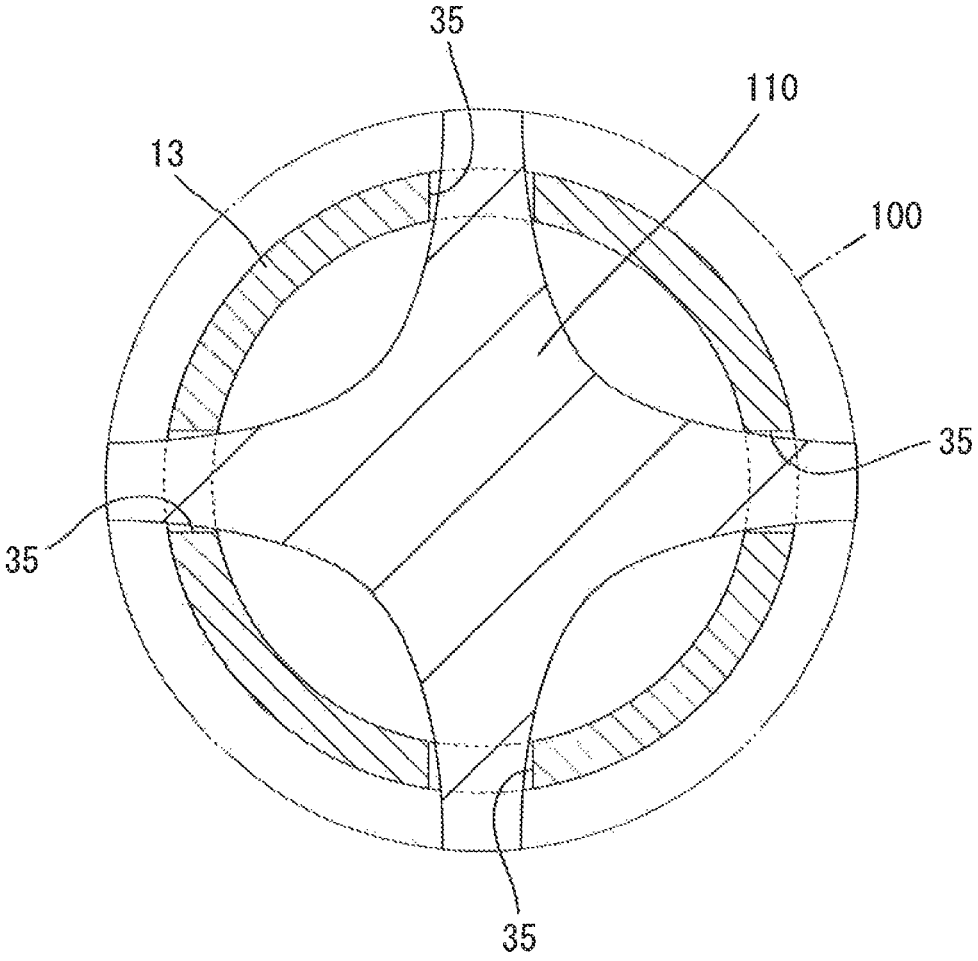
FIG. 4 is a sectional view of the lash adjuster, taken at the level of an engagement groove abutting against a screw tightening tool.

Four cutout-like engagement grooves 35 are formed in the upper end of the partitioning member 13 equiangularly or more specifically, circumferentially at intervals of 90° as shown in FIG. 4. A cross-head screwdriver 100 serving as a screw tightening tool includes a head or bit tip 110 with a cross shape. Each engagement groove 35 is formed into a shape conforming to the cross shape of the bit tip 110. When the threaded portion 39 is threadingly engaged with the threaded portion 38, the bit tip 110 of the cross-head screwdriver 100 is fitted into the engagement grooves 35 to be abutted against the grooves 35. The cross-head screwdriver 100 is turned about an axis thereof in the abutted state. The turning force of the cross-head screwdriver 100 is transmitted via the engagement grooves 35 to the partitioning member 13, so that the partitioning member 13 is also turned about an axis thereof. With turn of the partitioning member 13, the male thread of the threaded portion 39 is deeply engaged with the female thread of the threaded portion 38 with the result that the partitioning member 13 is screwed in the plunger 12.

In the manufacture of the lash adjuster 10, the partitioning member 13 is inserted into the plunger 12 through an upper end opening of the plunger 12 on which the support portion 25 has not been formed. The male thread of the threaded portion 39 is threadingly engaged with the female thread of the threaded portion 38. The upper end of the plunger 12 is squeezed in a diameter-reducing direction while the male thread is engaged with the female thread at a normal depth, whereby the support portion 25 is formed together with the through hole 24. In this case, the inner semispherical surface of the support portion 25 abuts against the upper end of the partitioning member 13 with the result that the partitioning member 13 is kept pressed by the plunger 12 from above. Accordingly, the coupled state of the partitioning member side threaded portion 39 and the plunger side threaded portion 38 can be prevented from loosening with the result that the coupled state of both threaded portions can reliably be maintained.

When the partitioning member 13 has been incorporated into the plunger 12, the oil passage 40 is defined between the peripheral wall 19 of the plunger 12 and the partitioning member 13 and above a coupling region 34 of the threaded portions 38 and 39 as shown in FIG. 2. In this case, the oil passage 40 has a lower end closed by the coupling region 34. Furthermore, the oil passage 40 faces the engagement grooves 35 in the upper end of the partitioning member 13, and the engagement grooves 35 have lower ends serving as oil pas sage ends 33 respectively. A space defined inside the partitioning member 13 serves as a low-pressure chamber 23.

The hydraulic fluid from the oil filler hole 92 of the cylinder head 90 is supplied sequentially through the outer oil passage hole 16, the oil passage hole 26, the oil passage 40 and of passage ends 33 to be reserved in the low-pressure chamber 23. The hydraulic fluid reserved in the low-pressure chamber 23 is further supplied through the valve hole 20 to fill the high-pressure chamber 22. In this case, since the oil passage ends 33 are located above the oil passage hole 26, the hydraulic fluid is reserved in the low-pressure chamber 23 to a level above the oil passage hole 26.

The valve element 21 closes the valve hole 20 thereby to close the high-pressure chamber 22 when a downward pressure is applied from the rocker arm 60 side to the plunger 12 in the state where the hydraulic fluid has been introduced into the low-pressure chamber 23 and the high-pressure chamber 22. As a result, the lowering of the plunger 12 is stopped by the hydraulic pressure of the high-pressure chamber 22. On the other hand, when the plunger 12 is raised with decrease in the pressure from the rocker arm 60 side, the capacity of the high-pressure chamber 22 is increased. When the capacity of the high-pressure chamber 22 is increased, the valve element 21 is lowered thereby to open the valve hole 20. As a result, the hydraulic fluid in the low-pressure chamber 23 flows through the valve hole 20 into the high-pressure chamber 22 thereby to fill the high-pressure chamber 22. Upon stop of the upward movement of the plunger 12, the valve element 21 is biased by the first spring 29 thereby to be moved upward and close the valve hole 20, so that the high-pressure chamber 22 is closed. Thus, the plunger 12 is moved up and down relative to the body 11, whereby the supporting position of the plunger 12 relative to the rocker arm 60 fluctuates with the result that a valve clearance is adjusted.

In the foregoing embodiment, the partitioning member side threaded portion 39 is coupled with the plunger side threaded portion 38, so that the partitioning member 13 is retained in the plunger 12. Consequently, the partitioning member 13 can easily be incorporated in the plunger 12, whereby the workload can be reduced. In particular, the difference between an inner diameter of the peripheral wall 19 of the plunger 12 and an outer diameter of the partitioning member 13 is absorbed by an overlap allowance, that is, an engagement allowance of the thread coupling region 34 of the threaded portions 38 and 39. Accordingly, a strict dimensional control is not required for the inner diameter of the peripheral wall 19 of the plunger 12 and the outer diameter of the partitioning member 13. In this respect, the above-described construction clearly differs from the conventional construction in which the partitioning member is press-fitted into the plunger. That is, machining or processing accuracy can be reduced. Furthermore, since an additional step such as shrinkage fitting is not required, the workability can be improved. Furthermore, since the partitioning member 13 has no radial stepped portions and extends straight in the up-down direction, the partitioning member 13 has little possibility of buckling in the incorporating process. Additionally, a head or hit tip 110 of the cross-head screwdriver 100 is abutted against the engagement grooves 35 in a fitted state, so that the screw tightening work is carried out. Consequently, a further better workability can be realized.

The foregoing embodiment should not be restrictive but may be modified as follows.

(1) The upper end of the partitioning member may be squeezed into a radially curved shape along the semispherical shape of the support portion.

(2) The plunger side threaded portion may be configured as a separate member which is secured to the inner periphery of the cylindrical body of the plunger. Similarly, the partitioning member side threaded portion may be configured as a separate member secured to the outer periphery of the cylindrical body of the partitioning member.

(3) The screw tightening tool should not be limited to the cross-head screwdriver but may be any tool that can be used for screw tightening. For example, the screw tightening tool may be a flat-head screwdriver. In this case, a pair of engagement grooves engageable with a head or tip of the flat-head screwdriver are recessed in the upper end of the partitioning member.

What is claimed is:

1. A lash adjuster comprising:

a body formed into a bottomed cylindrical shape;

a plunger which is inserted into the body so as to be movable up and down and has a bottom wall having a valve hole formed therethrough and a peripheral wall standing from an outer periphery of the bottom wall and having an oil passage hole formed therethrough, so that the plunger is formed into a bottomed cylindrical shape, the plunger defining a high-pressure chamber between the bottom wall and the body, the plunger including a plunger side threaded portion formed in an inner periphery of the peripheral wall thereof; and a partitioning member having a tubular shape and inserted into the plunger, wherein:

in a state where the partitioning member is inserted into the plunger, the partitioning member having an oil passage end located above the oil passage hole and an oil passage is defined between an outer surface of the partitioning member and the peripheral wall of the plunger;

a low-pressure chamber is defined inside the partitioning member to reserve hydraulic fluid flowing through the oil passage hole, the oil passage and the oil passage end into the low-pressure chamber, the hydraulic fluid reserved in the low-pressure chamber being supplied through the valve hole into the high-pressure chamber; and the partitioning member has an outer periphery formed with a partitioning member side threaded portion threadingly coupled with the plunger side threaded portion.

2. The lash adjuster according to claim 1, wherein the partitioning member is formed into a cylindrical shape extending in an up-down direction and has no stepped portions.

3. The lash adjuster according to claim 1, wherein the partitioning member has an upper end provided with an engagement groove which is abutted against a screw tightening tool thereby to transfer a turning force of the screw tightening tool.

4. The lash adjuster according to claim 3, wherein the engagement groove is formed by concaving the upper end of the partitioning member so as to have a shape corresponding to a cross head shape of a cross-head screwdriver or a flat head shape of a flat-head screwdriver, either screwdriver serving as the screw tightening tool.

5. The lash adjuster according to claim 1, wherein:

the plunger has a semispherical support portion swingably supporting a rocker arm;

the oil passage end is formed by concaving the upper end of the partitioning member; and the upper end of the partitioning member is retained in abutment with an inner semispherical surface of the semispherical support portion.

* * * * *